United States Patent [19]

Strohmeyer, Jr.

[11] 4,424,765

[45] Jan. 10, 1984

[54] STEAM GENERATOR HAVING EXTERNAL FLUIDIZED BED COMBUSTION MEANS

[75] Inventor: Charles Strohmeyer, Jr., Gladwyne, Pa.

[73] Assignee: Electrodyne Research Corporation, Gladwyne, Pa.

[21] Appl. No.: 371,528

[22] Filed: Apr. 26, 1982

[51] Int. Cl.[3] ..... B09B 3/00

[52] U.S. Cl. ..... 122/4 D; 110/245; 110/263; 431/170

[58] Field of Search ..... 122/40; 110/245, 263; 431/7, 170; 165/104.16

[56] References Cited

U.S. PATENT DOCUMENTS

| | | | |
|---|---|---|---|
| 3,863,606 | 2/1975 | Bryers et al. | 122/4 D |
| 4,240,377 | 12/1980 | Johnson | 122/4 D |
| 4,314,967 | 2/1982 | Kwon et al. | 431/7 |
| 4,336,769 | 6/1982 | Daman | 122/4 D |
| 4,338,074 | 7/1982 | Johansson | 431/7 |

*Primary Examiner*—Albert J. Makay
*Assistant Examiner*—Steven E. Warner
*Attorney, Agent, or Firm*—William J. Ruano

[57] ABSTRACT

The invention provides a means for more effectively adapting fluidized bed combustors for retrofit of existing boilers for burning of low grade inexpensive solid fuels. The operating discharge gas from a fluidized bed combustor is substantially lower in temperature from what exists at the furnace gas outlet of a conventional steam generator. Thus, outlet gas from fluidized bed combustors needs to be placed in the downstream gas path differently from conventional practice. The external combustors of the present invention permit placement of hot gas in the steam generator gas path where it can be effectively utilized. The invention also teaches how new steam generators can be configured advantageously to accommodate multiple fluidized bed combustors particularly as pertains to larger capacity steam generators in the 200 MW electrical and larger range.

5 Claims, 14 Drawing Figures

STEAM GENERATOR HAVING EXTERNAL FLUIDIZED BED COMBUSTION MEANS

Figure 1:
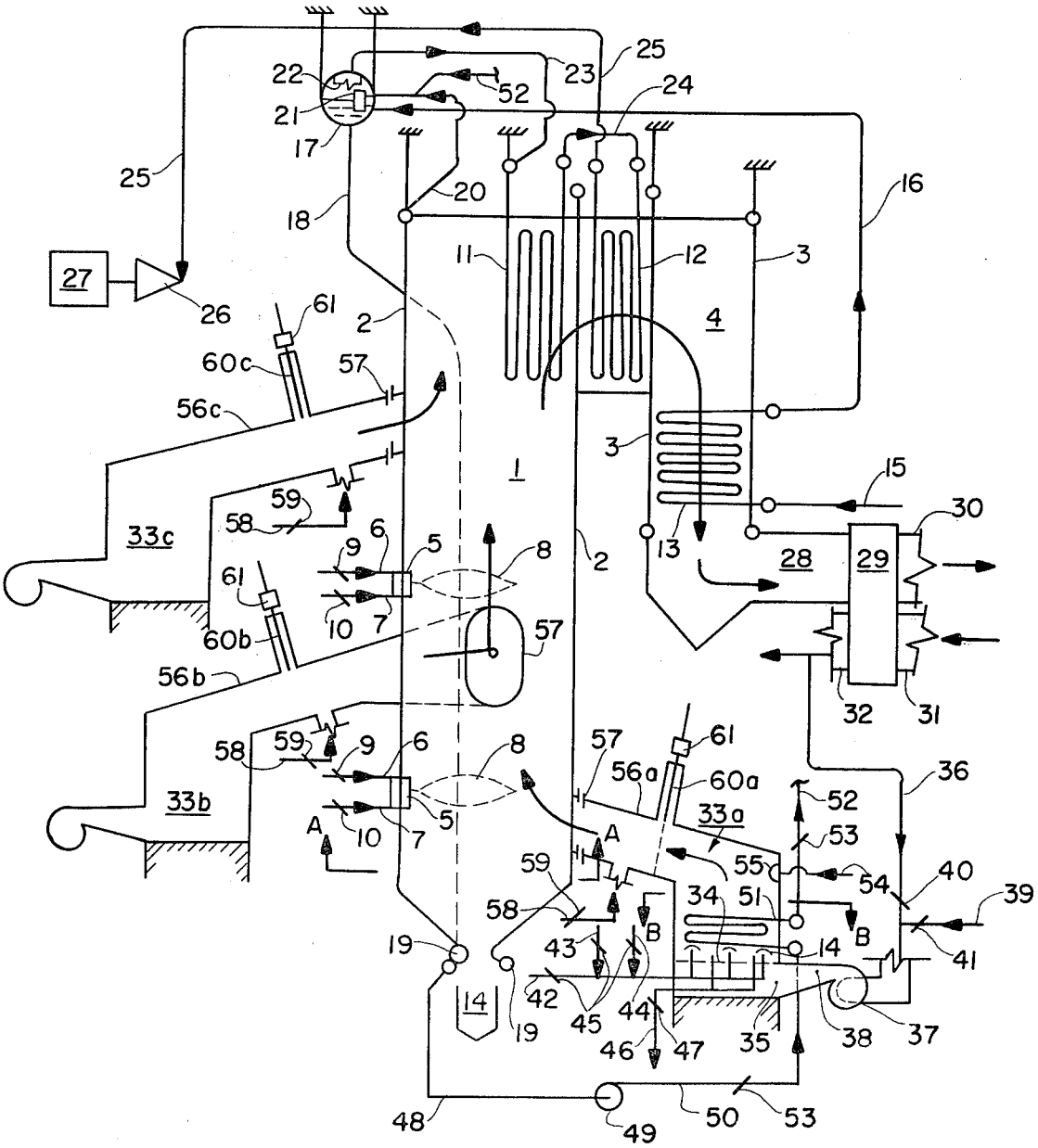

This invention relates to utilization of fluidized bed combustors in both existing and new steam generators. while the fluidized bed principle has been use effectively for small, low pressure, temperature steam generators, serious complications exist when applying such principles to larger utility type steam generators having high primary steam pressure and high primary and reheat steam temperature.

The discharge temperature from a fluidized bed combustor, when employing limestone in the bed for control of $SO_2$ emissions, is limited to 1650° F. Combustion takes place at much higher temperatures in a conventional steam generator and exit gas from the furnace can be in a range of 2000° F. or more in the case of large high pressure/temperature steam generators.

To overcome some of such problems, steam generating and superheating/reheating heat transfer surface is placed directly in the fluidized zone of the combustion bed. Such practice is expensive. In spite of such accomodation there are substantial amounts of low temperature heat recovery required at the steam generator outlet end in order to make the fluidized bed combustor option cost effective.

Unlike a conventional steam generator, a fluidized bed combustor does not require a large furnace plenum at the outlet of the bed. Much of the steam generation takes place in heat exchange surface located within the fluidized bed in contrast to the waterwalls of a conventional furnace. Thus, when retrofitting existing conventional steam generators to accomodate a new fluidized bed combustor, large furnace volume of the steam generator as initially installed can be a liability. A high up flow furnace places the superheating and reheating heat exchange circuits in areas which would normally be inaccessible to the high temperature outlet gases of a fluidized bed combustor. The horizontal cross section of the furnace is generally insufficient in area to permit full rating of the unit to be achieved. The reduced gas velocities and temperatures through the superheater and reheater lower the transfer rates resulting in outlet steam temperatures which are below design rating of the unit.

Little is known about fluidized bed combustors as applied to large steam generators. The use of conventional steam generator configurations for fluidized bed combustor applications involves considerable risk, particularly with regard to performance guarantees as there is limited background data available upon which to make design projections.

The versatility of the fluidized bed combustor in the burning of various low grade fuels, in a day of energy shortages, justifies the expenditure of considerable capital to make such option viable. There are large amounts of low grade anthracite and bituminous coal as well as all sorts of waste materials and trash available as fluidized bed combustor feedstock. When such low grade fuel can be burned at or near to the source and the cost of the fuel as fired is low, sacrifice in mechanical efficiency, as a result of lower steam pressure and temperature and the omission of reheat, is a practical option especially when cogeneration features are coupled with the application.

The present invention overcomes past difficulties in that overall capacity of the fluidized bed facility need not suit the configuration of the steam generator at any one location in the gas stream. Also, the gas discharge from the combustor/s can be segregated within the steam generator gas path common enclosure selectively to suit the specific requirements of alternative heat transfer duties as steam generation, superheating and feedwater heating. The bed can be designed appropriately and independently to achieve the desired steam generator rating and the bed hot outlet gases can be piped to the desired location in the existing gas path when retrofitting existing steam generators. Multiple combustors can discharge to alternative points in the existing gas path in a manner to balance overall heat transfer requirements.

In the case of existing boiler retrofits, support of the fluidized bed need not be dependent upon the existing steam generator structure other than that for partial loading from the interconnecting ductwork. The external combustor configuration disturbs an existing boiler configuration the least in the case of high stack type furnace configurations. Thus, where firing means are presently installed, they may be retained and utilized effectively to supplement the output from the fluidized bed combustors.

In the case of new steam generator designs, a multiplicity of fluidized bed combustors, which are at least partially segregated, permits all of the combustors to be located at and supported from a common base elevation. The combustors discharge to an integral containment shell in which there is disposed a gas path and gas-to-fluid heat exchange surface. The combustor gas discharge is segregated and allocated among respective duties as superheating, reheating, steam generation and feedwater heating. The interdependence with respect to apportionment of heat transfer among the respective duties is reduced as the requirements of each type of duty can be selectively satisfied by division of such duties among the multiple combustors. Such arrangement minimizes the risk associated with the design of large steam generators especially where there is a shortage of base data from past experience.

The present invention, coupled with the use of forced flow steam generating circuits, permits use of an entirely new steam generator structural configuration, wherein the unit, to a large extent, can be bottom supported. Also, the weight of the unit can be distributed over a larger area. The containment walls become localized structural members and their construction can be greatly simplified. Overall erection can proceed simultaneously thereby greatly reducing the time span required for erection.

The objects of this invention are related to the disposition of fluidized bed combustor/s with relation to the steam generator portions downstream. It is intended to provide a means whereby heat exchange surface located in the combustor discharge gases can be arranged more independently of the combustor/s configuration and in a manner whereby selective control of gas temperature to the respective heat exchange duties is possible, thereby balancing heat input to satisfy overall design criteria.

A specific object of this invention is to provide a means for adapting a conventional steam generator to receive hot gases from a fluidized bed combustor having tubular heat exchange surface immersed within the combustor combustion process, such surface being integrated with the connecting steam generator fluid circuits, all in a manner which results in minimum upset to the conventional steam generator configuration.

A still further object is to provide a configuration whereby the combustors can be supported independently of the connecting steam generator with means being provided to selectively discharge hot combustor outlet gases to various points in the steam generator gas path including those points which are not directly adjacent to each other.

A still further object is to provide a means for constructing a large capacity steam generator in the 200 MW electrical and larger range which comprises an integral enclosure wherein a gas path and gas-to-fluid heat exchange surface are disposed with a multiplicity of fluidized bed combustors external to the enclosure which are at least in part separated from each other and arranged to discharge hot gases to various locations in the integral enclosure in a manner to distribute heat selectively among the various portions of heat exchange surface disposed within the enclosure, said combustors also containing bed-to-fluid heat exchange surface immersed within the bed when fluidized.

A still further object is to provide means for distribution of hot gases from fluidized bed combustors, which are separate from each other and a steam generator furnace which is disposed for vertical flow, to various elevations of the vertical furnace for selective control of steam generation and superheating heat transfer rates within the downstream steam generator.

A still further object is to provide a means for isolation of the combustor/s from the downstream apparatus.

A still further object is to provide a means for isolation of the tubular heat exchange surface within the combustor/s from the connecting fluid circuits.

The invention will be described in detail with reference to the accompanying drawings wherein:

FIG. 1 is a schematic diagram of a steam generator having a furnace with fluidized bed combustors which are external to the furnace which illustrate the various objectives of this invention, FIG 2 is a steam generator circulatory system suitable for use with the steam generator configuration shown on FIG. 3, FIG. 3 is an orthographic projection in block form of a configuration for a steam generator having an integral enclosure comprising a gas path and gas-to-fluid tubular heat exchange circuits in combination with multiple combustors which are external to the integral enclosure and at least partially separated from each other, all suitable for large central station units having ratings of 200 MW electrical and larger, FIG. 4 is a typical section of an integral fluid cooled wall construction adapted for use as part of the FIG. 3 steam generator enclosure, and FIG. 5 is an arrangement of air and gas recirculation supply means for use with multiple fluidized bed combustors.

The invention is illustrated in FIG. 1. The steam generator furnace 1 is encased by waterwalls 2. The steam generator gas path 4, downstream of furnace 1, is encased by fluid cooled walls 3. Combustion burners 5 are equipped with a fuel supply 6 and air supply 7. Igniters (not shown) provide means for lighting burners 5. The combustion flame 8 extends out from burners 5 into furnace 1. Fuel and air flow control means 9 and 10 permit selective modulation of fuel and air flow respectively. This regulates heat input to furnace 1.

Primary superheater 11, secondary superheater 12 and economizer 13 are located in the gas path downstream of the combustion portion of furnace 1. Furnace 1 is of the dry bottom type arranged for collection of ash in hopper 14 which is provided with seals to the furnace bottom (not shown).

The steam generator fluid circulatory system is disposed as follows: high pressure feedwater pumps (not shown) pump heated feedwater through conduit 15 to economizer 13. Economizer 13 discharges through conduit 16 to vessel 17 to maintain water level to a predisposed range. From vessel 17 water flows down through conduit 18 and header 19 to supply waterwalls 2. Means not shown feeds water from vessel 17 to and through fluid cooled walls 3. Waterwalls 2 discharge to vessel 17 through conduit 20 and steam and water separator 21. Separated water is circulated again as it passes down through conduit 18. Separated steam passes through dryer screens 22 and conduit 23 to primary superheater 11 which is connected to secondary superheater 12 through conduit 24. Secondary superheater 12 discharges through conduit 25 to steam turbine 26 which drives electric generator 27.

Exit gas from economizer 13 passes through duct 28 to regenerative air heater 29 and out through duct means 30 to particulate removal equipment (not shown). Air from a forced draft fan (not shown) is delivered to regenerative air heater 29 through conduit means 31 and discharges through duct means 32 after heating to burner air supply conduits 7. Fuel supply to means 6 and burners 5 is not shown.

The above description covers a conventional steam generator and by itself is not part of this invention. In adapting such a design for fluidized bed firing it has been past practice to slice the furnace off at cross section A—A and relocate headers 19 at such point. The fluidized bed at cross section B—B would then be located directly under cross section A—A, the two cross section configurations being essentially the same and matching.

The fluidized bed combustor may be subdivided into multiple beds as 33*a*, 33*b* and 33*c*. Bed 33 is the generic reference for all such multiple beds. Fluidized bed combustor 33 has a bed support plate 34 with slots provided to permit uniform flow of air up through the bed from chamber 35. An air supply is obtained from duct 36 which is boosted in pressure by fan 37 which exhausts through duct 38 to chamber 35. Alternatively, air may be supplied to fan 37 through duct 39 directly from atmosphere. Means 40 and 41 selectively regulate air flow through the fan 37 supply ductwork. Pressurized transport air from duct 42 picks up fuel and inert material (bed filler) from conduits 43 and 44 respectively. Flow control means 45 selectively regulates flow of the respective materials through the respective conduits. Such mixtures enter the bed at multiple points so as to uniformly distribute the mixture throughout the bed. Distributors 14 are installed on the points of outlet to the bed. Spent ash is drawn from the bed selectively through conduit 46 and flow control means 47.

Feedwater supply from downcommer 18 is drawn through conduit 48 to circulator pump 49, through conduit 50 to bed-to-fluid tubular heat exchange surface 51 which is immersed in the bed when fluidized. The normal surface of the bed when operating is just above surface 51 and, when slumped (air flow off), the bed would drop below the tube level. Conduit 52 conveys the effluent from heat exchange surface 51 to separator 21 in vessel 17. Means 53 enables the tubular surface 51 to be isolated on the fluid side from the connecting circulatory system.

Alternatively, fuel and inert material could be supplied to the bed through conduit 54 to spreader 55 which distributes such material uniformly over the bed. Firing means (not shown) for ignition of the bed using a fuel as oil or gas is located in the bed zone. Limestone would replace the inert material for removal of $SO_2$ from the flue gas.

Locating combustor bed 33 at furnace cross section A—A would constrain the size of the bed which could be added to the steam generator of the example. Heat release associated with the fluidized firing principle, subject to the area A—A constraints, would normally be inadaquate to achieve the original rating of the steam generator. Also, heat in the gases to superheaters 11 and 12 would be at a lower than design level. This would result in outlet steam temperatures which were below rating.

The present invention overcomes such difficulties while retaining the existing configuration of the steam generator basically in tact. This enables continued operation of the original firing system as a means of supplementing output from the fluidized bed combustors. Also, it is possible to apportion heat output from the fluidized bed combustors between steam generating and superheater duty. This encourages conversions for firing low grade fuels which might otherwise be considered as waste. The ignition energy stored in a fluidized bed is high and makes it possible to burn a wide variety of such fuels.

According to the present invention the bed horizontal cross section area may be sized as required to suit the requirements of the overall steam generator. This may be done by use of either a bed area larger than permitted by the furnace horizontal cross section or use of a multiplicity of beds having an equivalent larger cross section area.

In the case of multiple beds, separation of such beds from each other enhances design flexibility. In an actual case it may be desired to substitute superheating heat transfer duty for steam generating duty in tubular heat exchanger 51. In starting up a unit there may be no steam flow available for cooling the superheat surface 51. Where such surface is located in one of a multiplicity of beds, such one superheat duty bed need not be fired until an adaquate flow of steam is available from another bed.

The general configuration of the original steam generator may not conveniently permit addition of fluidized bed combustors attached directly to the steam generator either due to space or weight limitations associated with the supporting structures and surrounding plant. The present invention permits the combustors to be installed apart from the original steam generator with means for piping the hot combustor outlet gases to the desired locations of the steam generator gas path. The tubular heat exchange surface within the beds can be coordinated with the various portions of the overall steam generator heat transfer apparatus to retain the original design performance parameters of the unit. The beds can be operated at appropriate times during unit startup and shutdown to assure an adequate supply of coolant through the respective bed tubular heat exchange circuits.

FIG. 1 shows a multiplicity of combustors 33*a*, 33*b* and 33*c* as subdivisions of generic combustor 33 described above. Each of combustors 33*a*, 33*b* and 33*c* is a separate unit supported individually and is separated from furnace 1.

Interconnecting ductwork 56*a*, 56*b* and 56*c* connect combustors 33*a*, 33*b* and 33*c* respectively to furnace 1. Expansion means 57 enable furnace walls 2 to move independently of ductwork 56*a*, 56*b* and 56*c*. Combustors 33*a*, 33*b* and 33*c* can be individually thermally insulated from furnace 1 by means of passing small amounts of air flow up through the bed from chamber 35 or alternatively through conduit 58 receiving air as from the air heater supply duct 31. Control means 59 selectively regulates flow through the associated conduit 58. Mechanical isolation of the combustors 33*a*, 33*b* and 33*c* can be achieved through selective closure of respective slide gates 60*a*, 60*b* and 60*c* each of which is driven by its own power operator 61.

Ducts 56*a*, 56*b* and 56*c* discharge to different locations of the furnace walls and at different elevations. The openings shown in the walls are representative only and do not reflect required cross section areas suitable for proper distribution of gas flows. Furnace waterwall tubes 2 in the area of the openings would be rerouted and/or respaced to permit flow of gases around or through groupings of such rerouted tubes from the combustors 33 to furnace 1. For example, waterwall tubes in the opening cross section area could be rerouted around the perimeter of the openings or every other tube could be realigned in series with an adjacent tube leaving an opening for the flow of gases in the space formerly occupied by the realigned tubes.

In the FIG. 1 case, tubular heat exchange surface in series with circuits 11 and 12 could be located in combustor 33*c* and/or 33*b* while surface 51 in combustor 33*a* was limited to steam generating duty. Ignition of combustors 33*c* and/or 33*b* could be delayed until steam was being generated and separated in vessel 17 for providing an adequate flow of a coolant to pass through surface 51 in combustors 33*c* and/or 33*b*.

Burners 5 can be used in combination with combustors 33 for startup or shutdown of the unit, or as a supplement during continuous operation for controlling steam outlet temperature or satisfying peaking heat input requirements.

The multiple combustors 33 need not discharge to furnace 1 at different elevations. A multiplicity of combustors could discharge to furnace 1 at the same elevation as the outlet portion of the furnace. Considerations affecting location of such discharge points, other than for the specific space occupied by burners 5, are separate from requirements associated with effective use of burners 5.

The location of combustors 33*a*, 33*b* and 33*c* can all be at the same elevation to accomodate fuel feed and disposal of ash. The length of connecting ducts 56*a*, 56*b* and 56*c* can vary to accomodate furnace 1 port locations compatible with overall heat transfer requirements of the system.

The above discussion relates to adapting a fluidized bed combustor to a conventional steam generator configuration. The fluidized bed combustor has inherent characteristics which can be more effectively utilized by restructuring the overall steam generator to suit the particular characteristics of the fluidized bed combustor.

Presently there are substantial limitations with respect to the capacity of steam generators which can be constructed utilizing fluidized bed combustors. Current designs which are developed are limited to a capacity range of 60 MW electrical. The principles of the present invention are discussed below to teach how the economy of size can be obtained from large capacity steam generators employing segregated fluidized bed combustors. Such applications will enable many low Btu content rejects as anthracite and bituminous culms, lignite, tar sands and other materials which would normally be considered as waste, to be effectively consumed, thereby increasing the available energy related natural resources throughout the world.

Steam generators must be capable of varying output from zero to rated steam flow to enable them to startup, shutdown and effectively satisfy variable load demand of a steam consumer. A fluidized bed combustor tends to be a constant output apparatus in as much as the firing rate can only be varied within a narrow bed temperature range satisfactorily for support of fuel ignition and removal of $SO_2$ from the flue gas. Such range is between 1350° F. and 1650° F. The top value can be extended to 1800° F. if removal of $SO_2$ from the flue gas, through mixture of limestone throughout the fluidized bed, is not required.

A multiplicity of combustors solves such problem. Combustors can be operated sequentially to satisfy varying loading requirements. As load is increased, more combustors are placed into service and vice versa as load is decreased. The following shows the advantages of at least partially segregating such multiple combustors from each other while achieving savings from a unitized convection pass structure at the outlet of the combustors.

It is desirable to install all combustors at ground elevation for convenience in the supply of fuel and air to the combustors. A horizontally disposed steam generator convection pass best suits such objective wherein the duct work required for connecting the individual combustors to the unitized convection pass structure is minimal.

Segregation of the combustors enables means to be installed for effective thermal and mechanical isolation of the individual combustors for sequencing their operation during variable loading conditions or for purposes of combustor maintenance while permitting the remainder of the unit to continue in operation.

An independent horizontal convection pass structure can be bottom supported. The interconnecting ductwork and convection pass enclosure can be constructed with minimum differential expansion resulting at the points where the interconnecting ductwork connects to the convection pass enclosure, thereby increasing the unit reliability. The low head, horizontal, bottom supported convection pass structure permits heavy structures, as mechanical dust collectors, to be integrated with and installed within the enclosure without the need for extensive interconnecting ductwork. Also, thermal expansion problems are simplified and for the most part sliding or bellows type of joints can be utilized.

Tubular heat exchange surface 51 located within the combustors 33 in combination with the above objectives can be best served by adoption of a forced flow steam generator fluid circuit as illustrated on FIG. *2a*. Conduit 15 delivers high pressure, preheated feedwater to economizer 13 which in turn discharges through conduit 16 to vessel 17 wherein steam and water are separated. Water level in vessel 17 is maintained within a predisposed range by flow control of feedwater makeup through conduit 15 (not shown). Water flows through downcommer 18 to pumps 49 in parallel and, after being increased in pressure, discharges to conduit 50. From thence, water flows through isolation means 53 to tubular gas-to-fluid heat exchanger surface 51 located in fluidized bed combustor 33. Additionally, conduit 50 discharges to circuits *2a*. Circuits *2a* are groups of multiple tubes which meander through the face planes of the convection pass enclosure walls generally in an upward direction. Flow through the tubular surface 51 and through the individual multiple tube groups *2a* is controlled by orifice means 62 which may be of the variable or fixed opening type. Conduit 52 returns the discharge from tubular surface 51 to vessel 17 wherein there is a means 21 for separation of steam and water. Discharge from circuit *2a* group of multiple tubes passes through conduit 20 to vessel 17 and steam and water separator 21.

Separated steam passes through conduit 23 to primary superheater 11, through conduit 24 to secondary superheater 12, through conduit 25 to steam turbine drive 26, through conduit 111 after expansion in turbine drive 26 to primary reheater 112 and secondary reheater 113 in series, through conduit 114 to reheat turbine drive 115, through conduit 116 after expansion in turbine 115 to steam condenser 117. Steam in condenser 117 is cooled and condensed by contact with cooling surface 119 wherein there is a flow of cooling water fed through conduit 118. The turbines 26 and 115 drive electric generator 27. The FIG. *2a* forced circulation feature eliminates need for a convection pass enclosure having fluid flow through the walls induced by gravity means as results from bubble formations in waterwall tubes of a conventional boiler.

FIG. 3 illustrates a configuration of a steam generator which is specifically adapted to suit fluidized bed combustors. Such steam generator incorporates the FIG. 2 circulatory system. A rating of 240 MW electrical is anticipated with primary steam pressure of 1800 psig and steam temperature of 950° F. at the turbine inlet. Reheat steam temperature at the turbine inlet is anticipated to be 950° F.

FIG. *3a* is a plan view looking down on the steam generator. FIG. *3b* and *3d* are front elevations of the steam generator. FIG. *3c* and *3e* are side elevations. FIGS. *3a*, *3b* and *3c* illustrate the external configuration of the structure. FIGS. *3d* and *3e* with supplementary FIGS. *3f* and *3g* illustrate disposition of tubular heat transfer surface within convection pass enclosure 63. Fluidized bed combustors 33*a*, 33*b*, 33*c*, 33*d*, 33*e*, 33*f*, 33*g* and 33*h* are segregated from each other and are bottom supported. Interconnecting ductwork 56 connects the individual combustors to various locations of convection pass enclosure 63.

Enclosure 63 includes zones A, B, C and D. Combustors 33*a*, 33*b* and 33*c* discharge to zone A. Combustors 33*d*, 33*e* and 33*f* discharge to zone B. Combustors 33*g* and 33*h* discharge to intermediate zone D which connects zones A and B with zone C. Gas flow through the enclosure passes individually and horizontally from zones A and B to zone D, thence up to zone C and horizontally and out through duct 28 to regenerative air heaters 29*a* and 29*b*, out through duct 30 to particulate removal apparatus 64, which may be of the baghouse or electrostatic precipitator type, and exhausts through duct 65 to induced draft fans which in turn discharge to a flue gas stack and atmosphere. Said induced draft fans and stack are not shown.

Figure 3A:
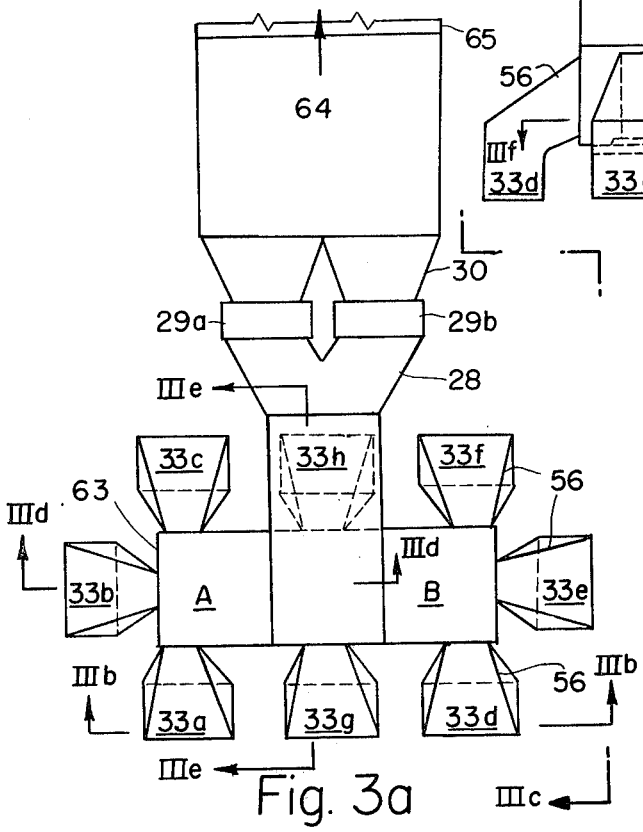
Figure 3C:
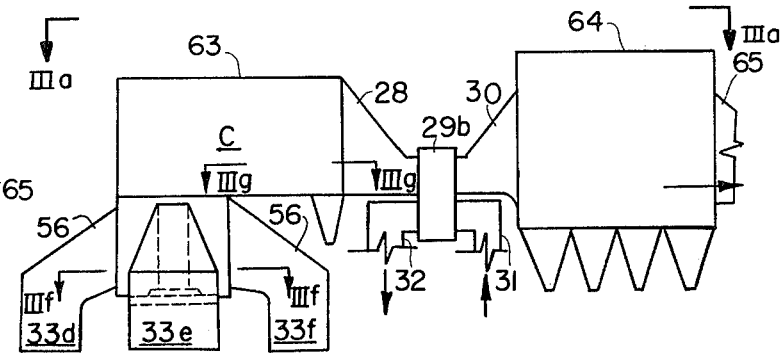
Figure 3D:
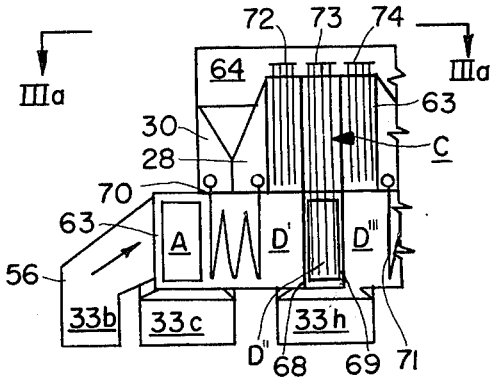
Figure 3B:
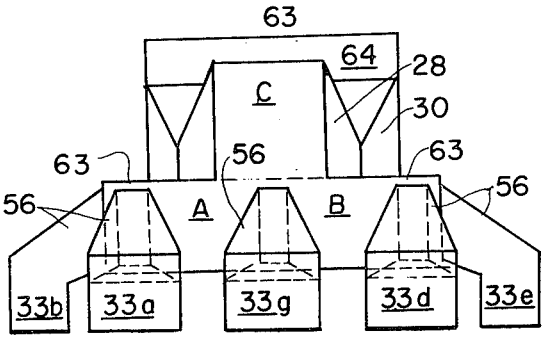
Figure 3E:
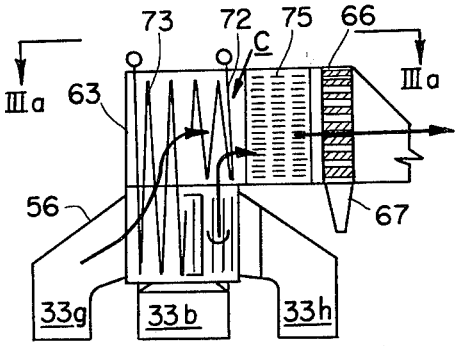

A mechanical tubular course dust collector 66 is shown on FIG. 3*e* and is installed in the gas stream at the outlet of zone C. The gas enters tubes which are provided with vanes to swirl the gas stream within the tubes. The heavy particles are thrown to the outer circumference of the tubes where they are trapped and removed through the space surrounding the tubes.

FIG. 5 illustrates an air supply and gas recirculation system adapted for the FIG. 3 steam generator configuration.

Referring to FIG. 3*d*, zone D is divided into three compartments D', D" and D"' by vertical division plates 68 and 69 which extend from enclosure 63 at the bottom of zone D to enclosure 63 which is at the top portion of zone C above zone D. Referring to both FIG. 3*d* and 3*e*, tubular heat exchange surface 72 consists of multiple heat exchanger platens. Flow is serially through the individual platen circuits and parallelly through the multiple platen circuits. Platens 72 are located in zone C in the compartment formed by division plate 68 and containment enclosure 63. Tubular heat exchange platens 70 are constructed similarly to platens 72 and are located in zone A as shown extending from front to rear. Platens 71 located in zone B are constructed and arranged similarly to platens 70. Platens 74 are similar to platens 72 and are located in zone C in the compartment formed by division plate 69 and containment enclosure 63.

Combustors 33*g* and 33*h* discharge to compartment D" located in zone D between vertical division plates 68 and 69. Tubular heat exchange platens 73 are similar to platens 72 but are longer and extend down from zone C to the bottom of compartment D". The portion of zone C which is downstream of platens 72, 73 and 74 is a common area.

Tubular heat exchange platens 75, similar to platens 72 but disposed horizontally, are located in the zone C common area. Platens 75 are dedicated to cold end heat recovery as economizer feedwater heating service. The tubes forming platens 75 are supported in vertical tube plates 78 parallel with the flow of gas. The ends of pairs of tubes in the same horizontal plane are progressively connected with return bends alternatively at opposite ends to make a series circuit through the horizontal platen. Such assembly can be bottom supported. FIG. 3*g* illustrates the arrangement of the platen 75 tube circuitry. The fluid flow through platens 70, 71, 72, 73, 74 and 75 is counter to the flow of gas over the platens. Tubular heat exchange surface 51 is located within each of combustors 33*a*, 33*b*, 33*c*, 33*d*, 33*e*, 33*f*, 33*g* and 33*h*.

Figure 3F:
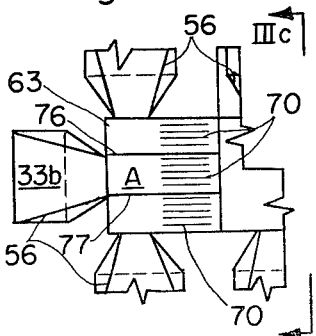
Figure 3G:
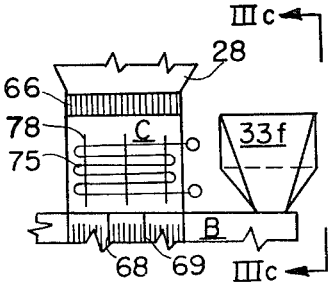

FIG. 3*f* shows how further compartmentation can be achieved. Division plates 76 and 77 are disposed vertically from top to bottom of zone A and are parallel with the flow of gas. They segregate the flow of gas from combustors 33*a*, 33*b* and 33*c*. Holes may be located in plates 76 and 77 to permit limited cross flow of gas for warming in the case where a combustor is out of service.

Horizontal type of platens arranged similarly to tubular heat exchange surface 75 could be substituted for the pendent type of tubular platens 70 and/or 71. Such assemblies can be designed for bottom support.

Where platen tubular surface is assigned steam generating duty, the platen circuitry would be arranged for flow through the platens in a continuous upward path. In such case horizontal portions of the tubes can be hung from membranes interconnecting the tube portions.

The gas exiting from combustors 33 can be in the 1650° to 1750° F. temperature range at peak firing conditions. Refractory in combustor 33 bed walls can safely contain such high temperature environment. With respect to the interconnecting ductwork 56, reference is made to boilers designed for the firing of brown coal in Europe wherein hot gases, in the temperature range of 1000° C., are drawn from the furnace outlet down through large diameter steel conduits lined with refractory on the inside to beater type mills below at ground elevation wherein the fibrous fuel stock is shredded and dried (excess of 40 percent moisture). The drying process lowers the gas temperature in the mill and a fan at the mill outlet blows the finely shredded fuel along with the recirculated gas to the furnace burners at which point fresh combustion air is injected along with the fuel and recirculated gas into the furnace.

In the case of combustors 33, some of the gas discharge can be recirculated through the bed as shown on FIG. 5. Such practice reduces the dry gas losses associated with the steam generator particularly in the low load range. Thus, based on present experience it is possible to construct a containment for combustors 33 including interconnecting ductwork 56 as well as for the inlet box upstream of tubular heat exchange surface 70 and 71 located in zones A and B of FIGS. 3*d* and 3*f*. Such containment need not include water or steam cooling features which would lower the gas temperature before it entered tubular surface 70 and 71 platens.

Platens 70 and 71 could be dedicated to superheating and reheating duty respectively. To provide a bias for individual control of superheat and reheat steam temperatures, tubular surface 70 in zone A could be more superheating than reheating and tubular surface 71 in zone B could be more reheating than superheating. Other similar combinations are possible.

Surface 51 is immersed in an activated fluidized bed combustor 33. By limiting such surface to steam generating duty, construction of surface 51 is simplified and cost is reduced. Heat transfer from the fluidized bed combustion process to the metal of tube 51 is high by comparison to heat transfer from the tube 51 metal to steam in the superheat range inside the tube. As a consequence exotic metals are required for such type of heat exchange apparatus as the tube metals tend to follow the bed combustion temperature rather than the fluid temperature within the tubes. Heat transfer from the tube 51 metal to water is extremely high and the tube metal will tend to more nearly approach the water temperature which is substantially lower than the superheat and reheat steam temperatures. Also, it is easier to maintain a protective flow of water in the tubes in times of emergency.

If required by the steam generator heat balance, enclosure 63 walls, parallel with tubular surface 70 and 71 and downstream, can be water cooled. The degree of such water cooling becomes optional and can be based on the economics of the respective cost of alternative mixes of component heat transfer surface.

FIG. 4 is an illustration of an integral water cooled wall and is part of this invention. It is desired to build the containment wall 63 flexible. While the wall is partially self supporting, related heavy structures are not dependent upon support from the wall. The walls primarily contain the gas path. To achieve flexibility, the steel plate 2*b* which interconnects the steel tubes 2*a* is of light gauge and is formed in a manner which permits differential expansion. Tubes 2*a* are located in segmented wall panels and several parallel tubes 2*a* may be fed water from a common header. The parallel tubes meander through the wall panels turning in the two dimentional wall plane 180 degrees in 90 degree steps to form U shaped layers of horizontal increments up through the wall panel and as shown on FIG. 2*a*.

Figure 4A:
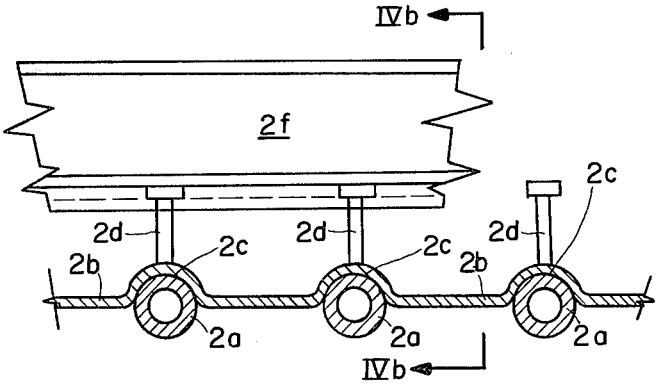
Figure 4B:
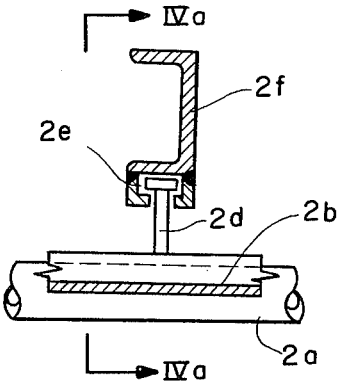
Figure 5A:
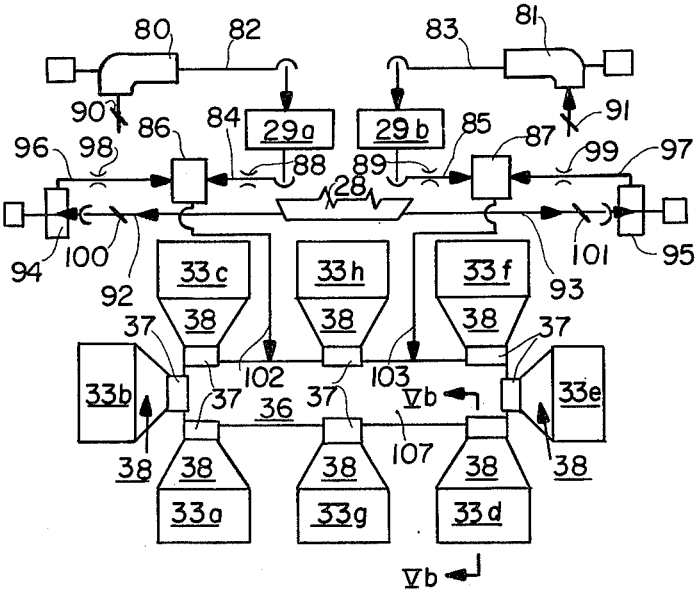
Figure 5B:
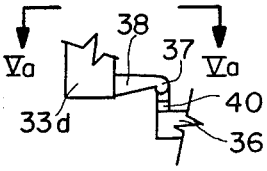

Steel plate 2*b* is pressed around steel tubes 2*a* or separately formed to accomodate tubes 2*a* as shown on FIG. 4*a*. Tubes 2*a* when aligned in place on shaped plate 2*b* are resistance welded to plate 2*b* at point 2*c*. The resistance weld may be continous or intermittent. Studs 2*d*, having a flanged head, are welded at the end opposite the flange to plate 2*b* over the resistance weld which connects plate 2*b* to tube 2*a*. The studs are also made from steel stock. The studs 2*d* are aligned so that the flanged head will slip into slot 2*e* of the wall support member 2*f*. The construction can be made from commercial steel shapes. The shaped portions of metal plate 2*b* surrounding tubes 2*a* partially permit a certain degree of flexibility and expansion within the panels to accomodate differential metal temperatures. See FIG. 4*b*.

Figure 2A:
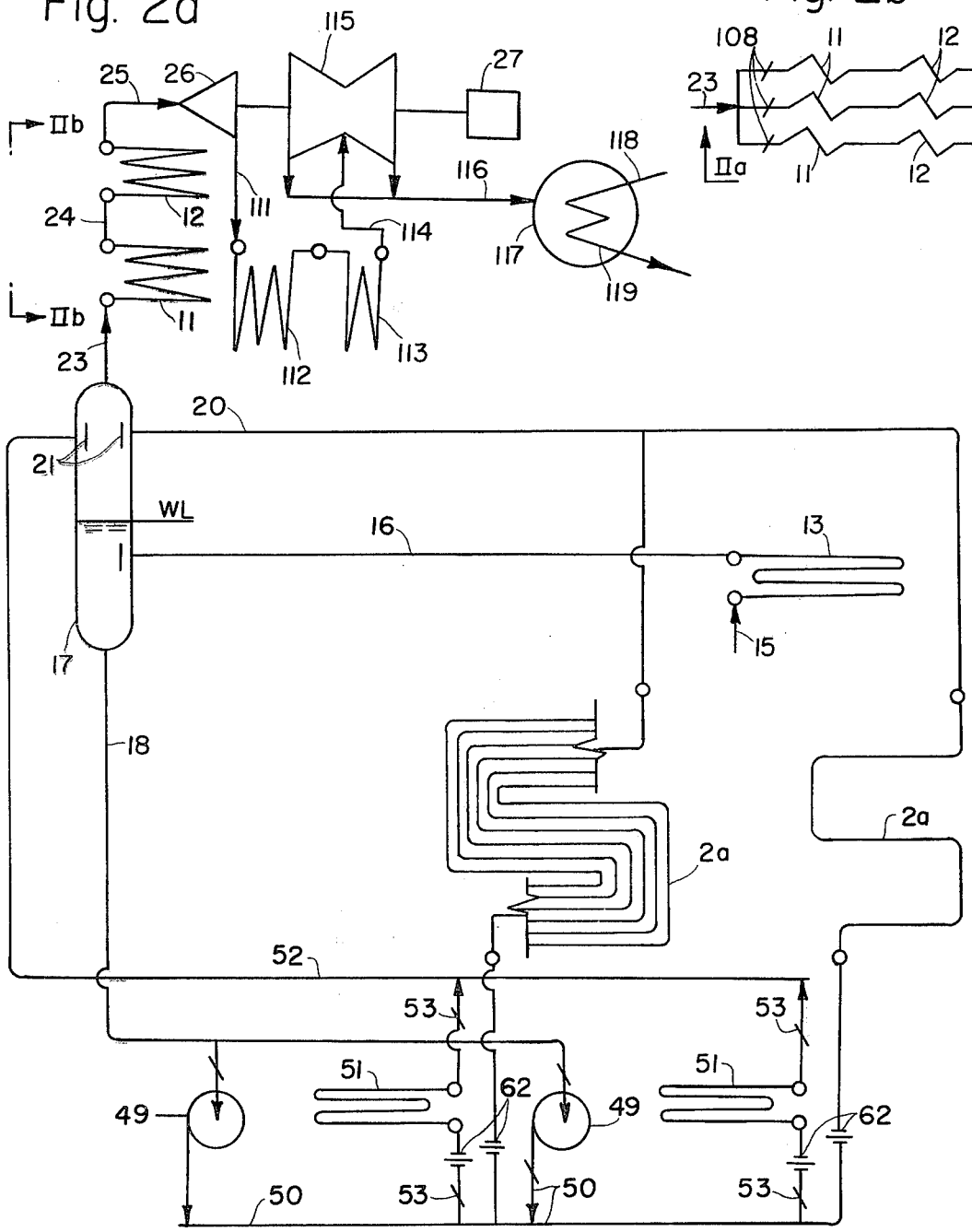

FIG. 3 in general is adapted for a fluidized bed combustor type steam generator that is particularly suited for the following tubular heat exchanger allocations all referenced to FIG. 2*a* circuitry: fluidized bed tubular surface 51 is primarily for steam generating duty; platens 70 and 71 or a mix thereof which are located in the high temperature gas zone are synonomous with high temperature superheater 12 and reheater 113; tubular platens 72 and 74 or a mix thereof are synonomous with primary superheater 11 and reheater 112; platens 75 are synonomous with economizer 13. Platens 73 along with combustors 33*g* and 33*h* are used as a startup and operational trim facility wherein platens 73 are a mix of superheat and reheat surface satisfactory for the intended purpose. Separation plates 68 and 69 can be water cooled according to the principles of FIG. 4 if such is appropriate to satisfy the overall heat balance of the system.

Alternatively, should it be desired to delegate tubular surface 51 for superheating or reheating duty, such surface would be synonomous with one or more of elements 11, 12,112 or 113 and as shown on FIG. 2*a*. FIG. 2*a* would be modified accordingly. Where surface 51 was assigned superheating duty, pressure drop through the circuits and/or orificing would substitute for pressure differential generated by circulator pump 49. Such an arrangement could eliminate the need for all or a part of heat exchange surface 70 and 71 in which case it may be desired to water cool the interconnection piece 56 and connecting enclosure 63 according to the principles of FIG. 4.

In any case, water cooled wall surface according to FIG. 4 would be located in enclosure 63 to satisfy the overall steam generator heat balance.

Figure 2B:
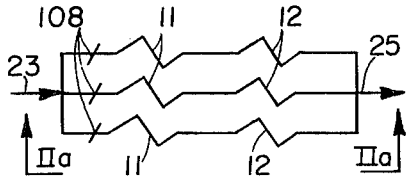

In the case where separator plates as 76 and 77 are installed in the gas path as shown on FIG. 3*f* (optional), it may also be necessary to be able to segregate flow in the corresponding fluid circuits as is shown on FIG. 2*b*. Isolation means 108 permit portions of the circuits to be isolated from the flow stream. Plates 76 and 77 are optional features to suit special situations. In general, the less the need to adjust the circuitry of the fluid path, the more reliable will be the operation of the unit.

FIG. 5 illustrates a combined air supply and gas recirculation system for a fluidized bed application which minimizes quantity of excess air exhausted to atmosphere. Such system is coordinated for use with FIG. 3 steam generator.

Motor driven forced draft fans 80 and 81 discharge through ducts 82 and 83 respectively to the air inlet of regenerative air heaters 29*a* and 29*b*. Ducts 84 and 85 convey the air heater discharges to mixing chambers 86 and 87 respectively. Venturies 88 and 89 are located in ducts 84 and 85 to measure the air flow through the respective ducts to the mixing chambers 86 and 87. Flow control means 90 and 91 located in the respective air inlets to fans 80 and 81 regulate air flow to the respective mixing chambers 86 and 87 responsive to a set point and measurement of actual air flow through venturies 88 and 89 which features are incorporated as part of said venturies.

Exhaust gas from duct 28 is drawn through ducts 92 and 93 to motor driven gas recirculation fans 94 and 95 respectively. Fans 94 and 95 discharge through ducts 96 and 97 and venturies 98 and 99 to mixing chambers 86 and 87 respectively. Flow control means 100 and 101 located in the respective gas inlets 92 and 93 to gas recirculation fans 94 and 95 regulate gas flow to the respective mixing chambers 86 and 87 responsive to a set point and measurement of actual gas flow through venturies 98 and 99 which features are incorporated as part of said venturie.

Through such means, control of air and gas flow to each of the respective mixing chambers can be achieved. There are two separate systems up to this point. The venturi set points for air and gas flows required are coordinated with the combustor 33 cordinated combustion control system (not shown).

Each of mixing chambers 86 and 87 discharge through separate ducts 102 and 103 to common plenum chamber 36 which furnishes a controlled, uniform mixture of air and gas to each of the combustor supply fans 37. Each of fans 37 is equipped with shutoff and flow control means 40 at the inlet for isolation and to regulate a uniform mixture of air and gas to the respective combustors. A measure of flow through each of fans 37 is the depth of the respective fluidized bed. Set point for venturi flow control means 88, 89, 98 and 99 is responsive to pressure measurement at point 107 and other means (not shown) as: operator or combustion control ratio adjustment between fan systems, overall steam generator loading, $O_2$ measurement at the combustor 33 outlets and various combinations of combustor loading. See FIG. 5*a* and FIG. 5*b*.

It is possible to bias firing rates between the A and B zones (combustors 33*a*, 33*b* and 33*c* vs. combustors 33*d*, 33*e* and 33*f*) for steam temperature control purposes. In such case, the respective air and gas supply systems vary the respective air and gas mixtures to suit the respective combustion requirements. Excess air in the system will be at a minimum since available air in the bed has an influence upon its combustion rate. Careful control of air flow carries with it certain safeguards with respect to steam generator operation. A fluidized bed combustor has less potential for a flame out situation compared with what can be experienced in a conventional combustion furnace.

Thus, it will be seen that I have provided an efficient embodyment for my invention, whereby a means is provided to adapt fluidized bed combustors in a manner to suit overall steam generator heat balance requirements, including superheating and reheating, through use of combustors which are segregated from each other, the discharge gas path from said combustors being adapted to selectively furnish heat to the respective serial portions of the steam generator fluid circuits to meet their individual requirements throughout the load range, said discharge portions being coordinated with tubular heat exchange surface immersed within said activated fluidized beds. An efficient means is devised for enclosing and supporting the fluidized bed exhaust gas path with accompanying heat exchange surface in a manner to permit efficient construction of steam generators 200 MW electrical and larger in capacity. Air supply and gas recirculation means are provided for the combustors to enable more efficient operation and coordinated control of a large steam generator embodying such principles.

While I have illustrated and described several embodiments of my invention, it will be understood that these are by way of illustration only and that various changes and modifications may be made within the contemplation of my invention and within the scope of the following claims:

I claim:

1. A steam generator having a feedwater inlet and superheated steam outlet and serially connected, coolant containing heat absorption circuits in-between, a multiplicity of detached fluidized bed combustors structurally and spacially set apart, the combustion process being completed within said combustors, said combustors each having means to control internal rate of combustion and to produce hot inert flue gas flow, first portion/s of said heat absorption circuits being disposed for in-bed cooling of said combustor fluidized beds, an integral encasement, said combustors external to said encasement, said encasement compartmentalized into discrete circuits for guiding flue gas flow through said encasement, said discrete circuits each receiving flue gas effluent from only a portion of said combustors directly through conduit means, second portion/s of said heat absorption circuits disposed within said encasement and adapted to recover heat from said flue gas flow, first segments of said second portion/s wherein the coolant is in the superheat vapor phase range, said first segments consisting of multiple heat exchange platens, coolant flowing serially through individual platen circuits and parallelly through said multiple heat exchange platens, said platens of said first segments disposed within the hot inlet end of said discrete circuits and distributed so that more heat exchange surface of one of said first segments is located in one of said discrete circuits than is located in another of said discrete circuits, said distribution of said platens for individual first segments between/among said discrete circuits providing the means for control of heat input distribution to said second portion/s of said serially connected heat absorption circuits in conjunction with selective setting of said rate of combustion for said combustors associated with individual elements of said discrete circuits.

2. A steam generator as recited in claim 1 and including second segment/s of said second portion/s of said serially connected heat absorption circuits and wherein the coolant is in the preheating phase, said second segment/s consisting of multiple platens, said second segment/s platens disposed in the cold outlet end of said integral encasement, optional means for preheating of air supply for said combustion process, said optional means and/or said second segment/s platens reducing said inert flue gas temperature to the range normally accepted for flue gases discharging to atmosphere.

3. A steam generator as recited in claim 1 including a reheater, said reheater reheating steam from said superheated steam outlet which is partially consumed, said reheater forming a portion of said serially connected heat absorption circuits downstream of said superheated steam outlet.

4. A steam generator as recited in claim 1 including coolant recirculation means maintaining balanced circulation through at least a portion of said heat absorption circuits wherein the coolant in said last portion is in the evaporation phase.

5. A steam generator as recited in claim 1 including gas recirculation means, including a gas recirculation fan, means for supply of said flue gas from said integral encasement after substantial cooling by said second portion/s of said heat absorption circuits to the inlet of said gas recirculation fan, means to deliver gas discharge from said gas recirculation fan at a controlled rate to said individual combustors as a supplement to said combustor combustion system air supply for adjustment of excess air at said combustor flue gas outlet while maintaining adaquate gas flow through said combustors to fluidize said beds throughout a significant portion of the load range.

* * * * *